US009546522B2

(12) United States Patent
In

(10) Patent No.: US 9,546,522 B2
(45) Date of Patent: Jan. 17, 2017

(54) LEAD SUPPORTING DEVICE OF DRILLING MACHINE

(76) Inventor: Suk Shin In, Gwangju (KR)

( * ) Notice: Subject to any disclaimer, the term of this patent is extended or adjusted under 35 U.S.C. 154(b) by 448 days.

(21) Appl. No.: 14/122,330

(22) PCT Filed: Jun. 7, 2012

(86) PCT No.: PCT/KR2012/004501

§ 371 (c)(1),
(2), (4) Date: Nov. 26, 2013

(87) PCT Pub. No.: WO2012/169803

PCT Pub. Date: Dec. 13, 2012

(65) Prior Publication Data

US 2014/0190714 A1 Jul. 10, 2014

(30) Foreign Application Priority Data

Jun. 7, 2011 (KR) ..... 10-2011-0054434

(51) Int. Cl.

| | |
|---|---|
| ***E21B 15/00*** | (2006.01) |
| ***E21B 1/00*** | (2006.01) |
| ***E21B 15/04*** | (2006.01) |
| ***E21B 19/08*** | (2006.01) |
| ***E21B 7/02*** | (2006.01) |

(52) U.S. Cl.

CPC ..... *E21B 15/00* (2013.01); *E21B 1/00* (2013.01); *E21B 7/023* (2013.01); *E21B 15/04* (2013.01); *E21B 19/08* (2013.01)

(58) Field of Classification Search

CPC ..... E21B 15/00; E21B 15/04; E21B 7/02; E04G 25/04; E04G 25/06; E04G 25/08; F16H 1/18; F16B 7/1418; F16B 7/1454; B66F 13/00

USPC ..... 173/31, 21; 248/666, 354.4, 411, 125.7, 248/510, 316.1, 316.5; 269/86, 89, 218; 74/813 L; 92/15; 52/297; 254/97; 403/109.2, 109.5, 109.7

See application file for complete search history.

(56) References Cited

U.S. PATENT DOCUMENTS 1,396,317 A * 11/1921 Boyter ..... E21B 19/06 294/102.2
2,118,361 A * 5/1938 Schaeffer, Jr. ..... F16B 37/0821 292/305
2,565,777 A * 8/1951 Moon ..... E04H 12/18 182/63.1

(Continued)

FOREIGN PATENT DOCUMENTS

| | | |
|---|---|---|
| JP | 05-22688 | 3/1993 |
| JP | 07-011651 | 1/1995 |
| JP | 2007-132090 | 5/2007 |

*Primary Examiner* — Thanh Truong
*Assistant Examiner* — Dariush Seif
(74) *Attorney, Agent, or Firm* — Lex IP Meister, PLLC

(57) ABSTRACT

The present invention relates to a lead supporting device of a drilling machine. The lead supporting device of the drilling machine includes: a frame of the drilling machine; a lead coupled to the frame of the drilling machine by a hinge shaft, the lead being rotated in a predetermined angle; main cylinders disposed on the frame of the drilling machine and the lead to rotate the lead with respect to the frame; a head part elevatably disposed on the lead to perform a drilling process; a rotatable guide body coupled to the frame of the drilling machine by the hinge shaft; a guide rod rotatably hinge-coupled to the lead, the guide rod being slidable along the guide body; and a lead position fixing unit including a grasping part disposed on the guide body to fix the guide rod to the guide body, thereby fixing the position of the lead.

5 Claims, 4 Drawing Sheets

(56) References Cited

U.S. PATENT DOCUMENTS 2,689,549 A * 9/1954 Hayman ..... B66C 13/18 52/115
3,245,180 A * 4/1966 Bules ..... E21B 7/02 52/116
3,710,876 A * 1/1973 Christensen ..... E21B 11/02 173/1
3,778,940 A * 12/1973 Blecken ..... E21B 7/02 52/116
3,815,434 A * 6/1974 Seger ..... E04G 25/06 411/433
3,965,628 A * 6/1976 Loftis ..... E21B 19/084 173/26
3,978,605 A * 9/1976 Maruniak ..... A01K 97/14 294/115
3,992,831 A * 11/1976 Bukovitz ..... E21B 15/04 173/193
4,368,602 A * 1/1983 Manten ..... E21B 7/024 173/28
4,606,155 A * 8/1986 Bukovitz ..... E04H 12/34 173/193
4,892,160 A * 1/1990 Schivley, Jr. ..... E21B 19/146 175/52
5,033,554 A * 7/1991 Younes ..... E21B 3/02 173/145
5,119,585 A * 6/1992 Camp ..... A01K 97/00 177/131
5,269,386 A * 12/1993 Schivley, Jr. ..... E21B 7/02 175/209
5,794,723 A * 8/1998 Caneer, Jr. ..... E21B 15/04 175/202
6,116,118 A * 9/2000 Wesch, Jr. ..... B25B 5/147 81/57.16
6,953,314 B2 * 10/2005 Magagna ..... E03C 1/0401 411/301
2010/0187740 A1 * 7/2010 Orgeron ..... B25B 5/061 269/218
2011/0048807 A1 * 3/2011 In ..... E02D 1/04 175/195
2015/0144402 A1 * 5/2015 Gustavsson ..... E21B 19/20 175/52
2016/0130890 A1 * 5/2016 Wase ..... E21B 19/155 175/52

* cited by examiner

LEAD SUPPORTING DEVICE OF DRILLING MACHINE

TECHNICAL FIELD

The present invention relates to a lead supporting device of a drilling machine, and more particularly, to a lead supporting device of a drilling machine, which can maintain its posture at a maintenance angle in a state in which a lead of the drilling machine is maintained at a predetermined angle.

BACKGROUND ART

In general, a drilling machine, which is used to drill deep holes into the ground for purposes of drilling, soil testing or development of underground water, may be classified into a type in which a drilling work is performed while rotating a rod having a bit, and a type in which a drilling work is performed by rotating a rod having a bit or a cutter and striking the bit or the cutter using the rod.

A conventional drilling machine is disclosed in Korean Patent No. 624233. The disclosed drilling machine comprises a main body having a driving device such as an engine, a leader supported by the main body, and a head sliding along the leader and generating an elevational force or a rotational force by a driving device provided in the main body, a rod coupled to the head and elevating or rotating by the head, and a drilling unit provided at a front end of the rod and perforate the ground while elevating or rotating along with the rod.

Since a drilling work using the aforementioned drilling machine is performed in a state in which a lead is maintained at a predetermined angle with respect to a main body, a position of the lead with respect to the main body is fixed in consideration of safety. The position of the lead is fixed by installing separate brackets on the main body of the drilling machine and the lead to then fix the lead using a coupling device of the main body of the drilling machine and the lead or by installing separate support bars between the lead and the main body.

However, the aforementioned lead position fixing structure using the coupling device or the support bars has several problems in that a worker cannot eliminate the structure in the middle of working, and it may be damaged when a cylinder as an actuator for adjusting a rotation angle of the lead is actuated. In particular, when the cylinder is actuated to adjust the rotation angle in a state in which the position of the lead is fixed, peripheral devices for rotating the lead with respect to the main body may be damaged.

DISCLOSURE OF THE INVENTION

In order to overcome the above-mentioned shortcomings, the present invention provides a lead supporting device of a drilling machine, lead supporting device of a drilling machine, which can fix a position of a lead rotatably installed with respect to a frame and which operates in an interlocking manner with actuation of cylinders.

The present invention also provides a lead supporting device of a drilling machine, which can prevent a lead from malfunctioning when a position of the lead is fixed and the fixed lead is released and can improve the reliability in fixing the position of the lead.

The present invention also provides a lead supporting device of a drilling machine, which can prevent a rotation angle of a lead from being changed by an external force applied to the lead when the lead is supported.

According to an aspect of the invention, there is provided a lead supporting device of the drilling machine including a frame of the drilling machine, a lead coupled to the frame of the drilling machine by a hinge shaft, the lead being rotated in a predetermined angle, main cylinders disposed on the frame of the drilling machine and the lead to rotate the lead with respect to the frame, a head part elevatably disposed on the lead to perform a drilling process, a rotatable guide body coupled to the frame of the drilling machine by the hinge shaft, a guide rod rotatably hinge-coupled to the lead, the guide rod being slidable along the guide body, a lead position fixing unit including a grasping part disposed on the guide body to fix the guide rod to the guide body, thereby fixing the position of the lead with respect to the guide body.

In the present invention, a hollow part may be lengthwise formed on a guide body installed in the frame of the drilling machine and a guide rod coupled to the lead by a hinge shaft may be slidably coupled to the hollow part.

The gripping part of the lead position fixing unit may include a support frame installed on the guide body, and first and second gripping members installed on the support frame to be rotatable about the support shaft; the first gripping member may include a first jaw for gripping the guide rod and a first shank unit extending from the first jaw and rotating the first gripping member about the support shaft; the second gripping member may include a second jaw for gripping the guide rod with the first jaw and a second shank unit extending from the second jaw and rotating the second gripping member about the support shaft; and the first and second shank units may be connected to rods of cylinders installed in the support frame by first and second links.

In addition, in order to increase a gripping force, uneven parts may be formed on the outer circumferential surface of the guide rod and inner circumferential surface of the first and second gripping parts. The uneven parts may include recessed grooves formed on the guide rod along the outer circumferential surface of the guide rod and protrusions formed on the first and second gripping parts to be engaged with the recessed grooves.

As described above, in the lead supporting device of a drilling machine according to the present invention, the angle of the lead can be fixed at an arbitrary position. In addition, it is possible to fundamentally prevent the lead position fixing device or apparatus from being damaged when the angle of the lead is adjusted in an event of a malfunction or a worker's mistake.

BRIEF DESCRIPTION OF THE DRAWINGS

The objects, features and advantages of the present invention will be more apparent from the following detailed description in conjunction with the accompanying drawings, in which.

BEST MODE FOR CARRYING OUT THE INVENTION

Figure 1:
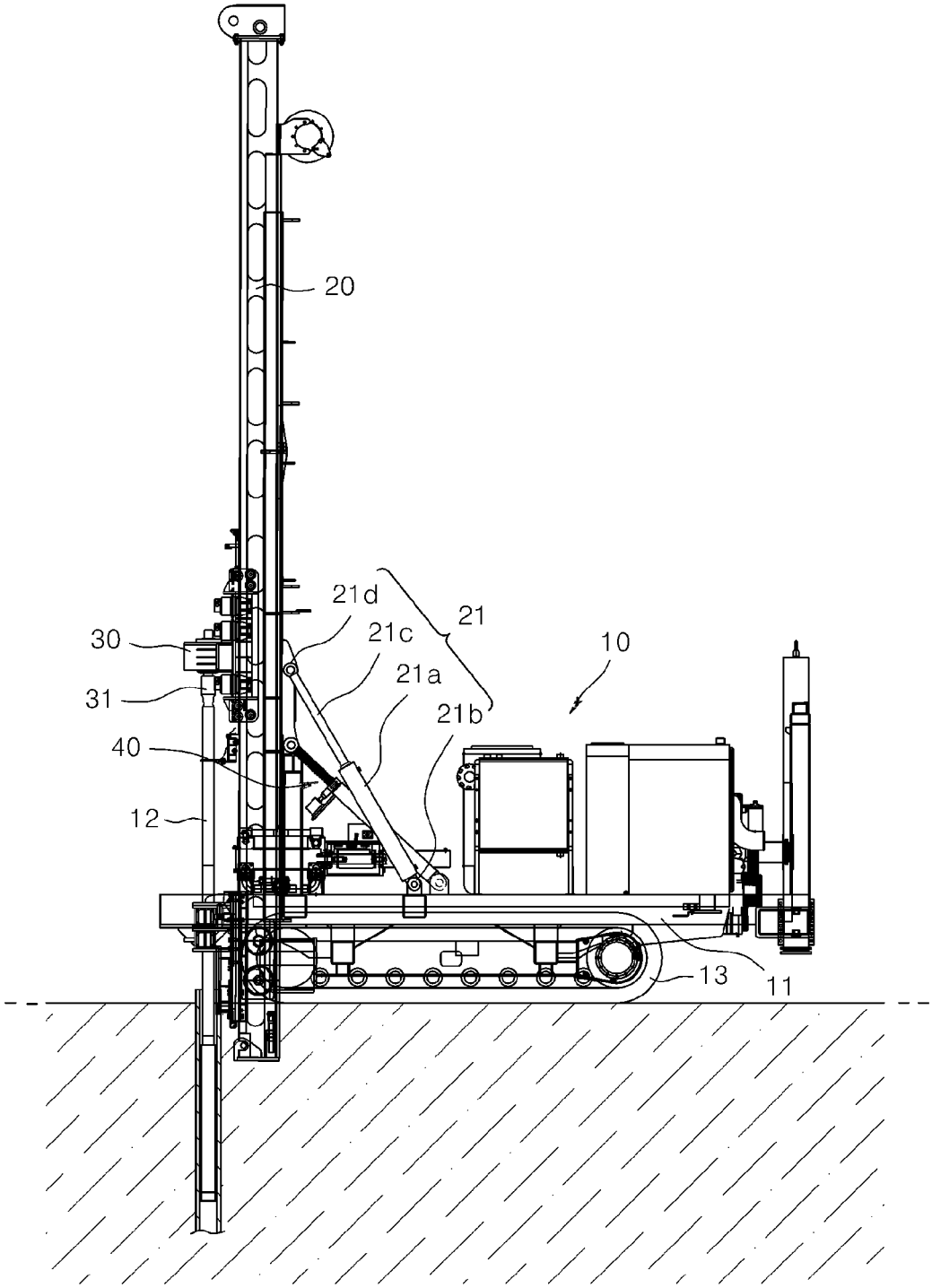
FIG. 1 is a side view schematically illustrating a drilling machine according to the present invention.

Hereinafter, embodiments of the present invention will be described in detail with reference to the accompanying drawings.

The present invention relates to a drilling machine, and more particularly, to a rod supporting device of a drilling machine for fixing a position of a lead whose head part is elevated to perform a drilling work, and an exemplary embodiment thereof is illustrated in FIGS. 1 to 4.

Referring to FIGS. 1 to 4, the drilling machine 10 having a lead supporting device includes a lead 20 supported by a main body thereof, that is, a frame 11 and rotated in a predetermined angle by a main cylinder 21, a drive shaft 31 slidably installed in the lead 20 and has a rod 12 used in a drilling work connected thereto, a head part 30 having a hydraulic motor for driving the drive shaft 31, and a lead position fixing unit 40 installed on the frame 11 and the lead 20 and fixing a rotation position of the lead 20.

A wheel 13 moving on an endless track is installed under the frame 11 to move the frame 11. The wheel 13 traveling on the endless track is actuated by an engine installed in the frame 11. Although not shown, the actuation of the wheel 13 is achieved such that a hydraulic pump is driven by the engine installed in the frame 11 and a hydraulic motor is actuated by a hydraulic fluid pumped by the hydraulic pump. The hydraulic fluid driven by a general hydraulic pump is provided to drive the drilling machine 10 including the main cylinder 21 for adjusting an angle of the lead 20, the hydraulic motor for driving the drive shaft 31 of the head part 30.

As described above, the lead 20 is hinged to the frame 11 by a hinge shaft 25 to be rotatable with respect to the frame 11 and is rotated by the main cylinder 21 coupled to the frame 11 and the lead 20 at its opposite ends using pins. In the main cylinder 21, a cylinder body 21*a* is rotatably hinged to the frame 11 of the drilling machine 10 by a first hinge shaft 21*b*, and a cylinder rod 21*c* is hinged to the lead 20 by a second hinge shaft 21*d*. While one main cylinder 21 is illustrated in FIG. 1, at least two main cylinders 21 may be installed.

Figure 2:
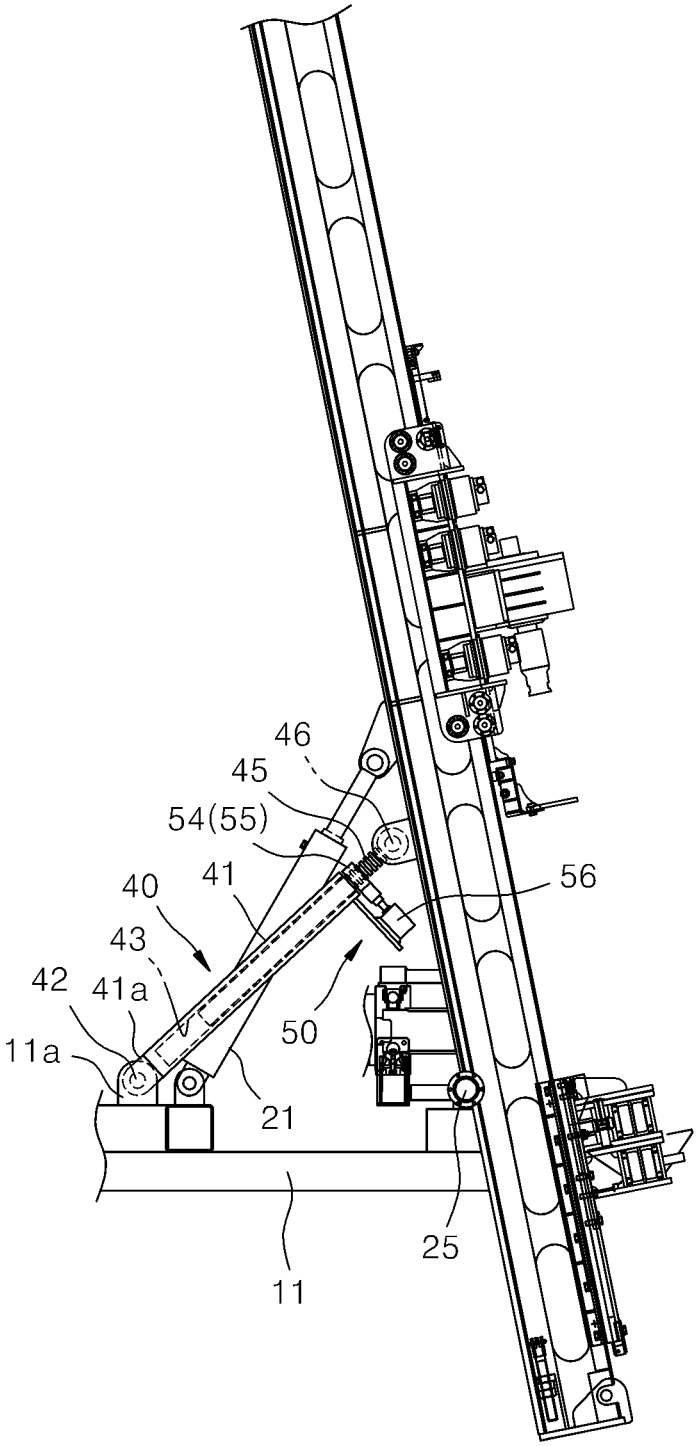
FIG. 2 is an exploded side view of a lead supporting device of a drilling machine according to the present invention.
Figure 3:
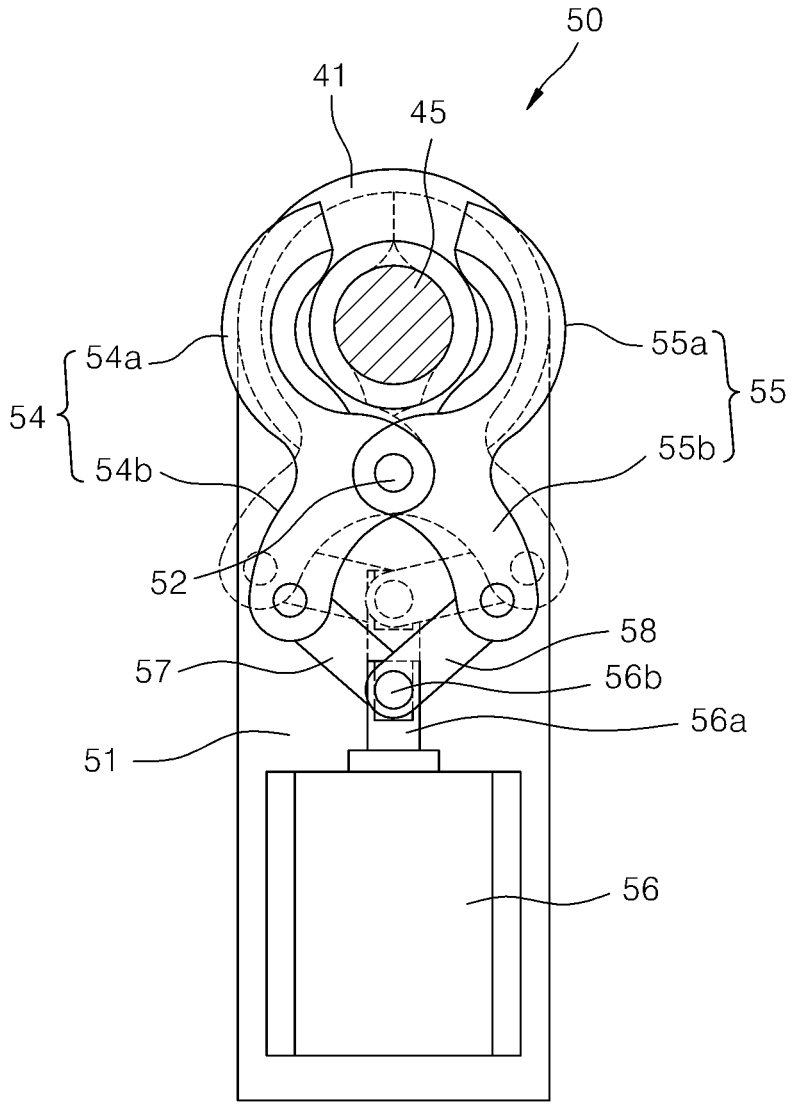
FIG. 3 is a plan view illustrating a gripping part of a lead supporting device according to the present invention.
Figure 4:
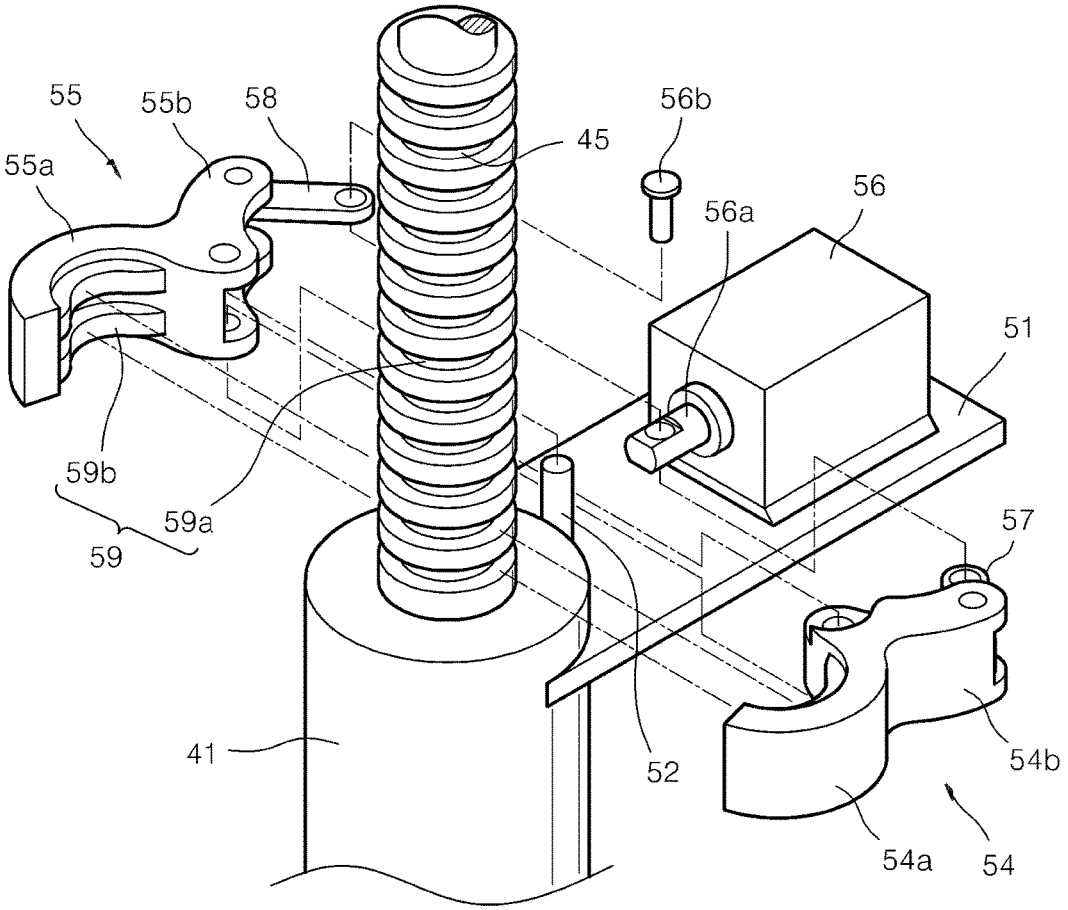
FIG. 4 is an exploded perspective view of a lead position fixing unit according to the present invention.

The lead position fixing unit 40 is installed between the frame 11 and the lead 20 and fixes a posture of the lead 20 rotated in a predetermined angle by the main cylinder 21, as shown in FIGS. 2 and 4.

Referring to FIG. 2, the lead position fixing unit 40 is configured such that the guide body 41 is rotatably installed on the frame 11 with a variation in the angle of the lead 20. The guide body 41 is installed on the frame 11 by coupling hinge brackets 11*a* and 41*a* provided in the frame 11 and the guide body 41 by a third hinge pin 42. A hollow part 43 is formed lengthwise from an end of the guide body 41. A guide rod 45 slidably inserted into the hollow part 43 is hinged to the lead 20 by a fourth hinge shaft 46.

In addition, a gripping part 50 is installed in the guide body 41. The gripping part 50 grips the guide rod 45 in an interlocking manner with actuation of the main cylinder 21 adjusting the angle of the lead 20 to prevent the guide body 41 from being slidably inserted into the hollow part 43.

The gripping part 50 of the lead position fixing unit 40 includes a support frame 51 installed on the guide body 41, and first and second gripping members 54 and 55 installed in the support frame 51 to be rotatable about the support shaft 52.

The first gripping member 54 includes a first jaw 54*a* for gripping the guide rod 45 and a first shank unit 54*b* for rotating the first jaw 54*a* about the support shaft 52. The second gripping member 55 includes a second jaw 55*a* for gripping the guide rod 45 and a second shank unit 55*b* for rotating the second jaw 55*a* about the support shaft 52. In addition, the support frame 51 includes a cylinder for rotating the first and second shank units 54*b* and 55*b*, that is, a hydraulic cylinder 56. A rod 56*a* of the hydraulic cylinder 56 is connected to the first and second shank units 54*b* and 55*b* by first and second links 57 and 58. The first and second shank units 54*b* and 55*b* are connected to the rod 56*a* of the hydraulic cylinder 56 by the first and second links first and second links 57 and 58.

Here, the cylinder 56 is driven in an interlocking manner with the actuation of the main cylinder 21. During the actuation of the main cylinder 21, a hydraulic fluid is supplied to the main cylinder 21 to release the gripping. Preferably, the main cylinder 21 is actuated to grip the guide rod 45 when the supplying of the hydraulic fluid to the main cylinder 21 is stopped.

In order to increase a gripping force of the guide rod 45 using the first and second jaws 54*a* and 55*a*, uneven parts 59 are formed on an outer circumferential surface of the guide rod 45 and inner circumferential surfaces of the first and second jaws 54*a* and 55*a*. The uneven parts 59 are formed such that a plurality of ring-shaped recessed grooves 59*a* are formed on the outer circumferential surface of the guide rod 45 in an outer circumferential direction, and protrusions 59*b* engaged with the recessed grooves 59*a* are formed on the inner circumferential surfaces of the first and second jaws 54*a* and 55*a*.

The lead position fixing unit of the aforementioned drilling machine according to the present invention operates as follows.

First, in order to form a bore hole using the drilling machine, the drilling machine is moved to a location for bore hole formation, and the lead is rotated with respect to the frame 11 in a predetermined angle in consideration of a direction in which the bore hole to be drilled is formed. The rotating of the lead 20 is achieved by supplying a hydraulic fluid pumped by the hydraulic pump installed in the frame 11 to the main cylinder 21. At this stage, the hydraulic fluid is supplied to the hydraulic cylinder 56 of the lead position fixing unit 40 to allow the first and second gripping members 54 and 55 of the gripping part 50, that is, the first and second jaws 54*a* and 55*a*, to get away from each other, thereby engaging/disengaging the guide rod 45 connected to the lead 20 with/from the hollow part 43 of the guide body 41.

When the adjusting of the angle of the lead 20 is completed, the supplying of the hydraulic fluid to the main cylinder 21 is stopped and the cylinder 56 is actuated for rotating the first and second jaws 54*a* and 55*a* to grip the guide rod 45.

The plurality of recessed grooves 59*a* are formed on the outer circumferential surface of the guide rod 45 to be spaced a predetermined interval apart from each other, and the protrusions 59*b* engaged with the recessed grooves 59*a* are formed on the inner circumferential surfaces of the first and second jaws 54*a* and 55*a*.

When the guide rod 45 is gripped by the first and second jaws 54*a* and 55*a*, the protrusions 59*b* are engaged with the recessed grooves 59*a*, thereby reducing slips of the recessed grooves 59*a* and the protrusions 59*b* and ultimately increasing the bearing capacity therebetween.

When the main cylinder 21 for adjusting the angle of the lead 20 is actuated in a state in which a position of the lead 20 is fixed, the cylinder 56 of the lead position fixing unit 40 is actuated to allow the first and second jaws 54*a* and 55*a* from being released from the guide rod 45, thereby facilitating engagement/disengagement of the guide rod 45 with/from the hollow part 43 of the guide body 41.

The main cylinder 21 and the cylinder 56 may operate in an interlocking manner by a hydraulic fluid distribution circuit including a control valve and a relief valve.

Although an exemplary embodiment of the present invention has been described in detail hereinabove, it should be understood that many variations and modifications of the basic inventive concept herein described, which may appear to those skilled in the art, will still fall within the spirit and scope of the exemplary embodiments of the present invention as defined by the appended claims.

What is claimed is:

1. A lead supporting device of a drilling machine, comprising:

a frame of the drilling machine;

a lead coupled to the frame of the drilling machine by a first hinge shaft, the lead being rotated in a predetermined angle;

main cylinders disposed on the frame of the drilling machine to rotate the lead with respect to the frame;

a head part elevatably disposed on the lead to perform a drilling process;

a rotatable guide body coupled to the frame of the drilling machine by a second hinge shaft;

a guide rod rotatably hinge-coupled to the lead, the guide rod being configured to slide along the guide body; and a gripping part installed on the guide body to fix the guide rod to the guide body, wherein the gripping part includes:

a support frame fixed to the guide body and having a support shaft;

a gripping cylinder installed on the support frame and having a gripping rod;

a first gripping member including a first jaw for gripping the guide rod, a first shank unit extending from the first jaw, and a first hole disposed at a head part of the first shank unit;

a second gripping member including a second jaw for gripping the guide rod, a second shank unit extending from the second jaw, and a second hole disposed at a head part of the second shank unit;

a first link connecting the first gripping member to the gripping rod with hinge connections; and a second link connecting the second gripping member to the gripping rod with hinge connections, wherein the support shaft is inserted though the first hole of the first gripping member and the second hole of the second gripping member, thereby being a common rotation axis of the first gripping member and the second gripping member.

2. The lead supporting device of claim 1, wherein the guide body has a hollow part formed in lengthwise, and the guide rod is coupled to the lead by a third hinge shaft and slidably inserted into the hollow part.

3. The lead supporting device of claim 2, wherein grooves are formed on an outer circumferential surface of the guide rod and protrusions are formed on an inner circumferential surface of the first and second gripping members to be engaged with the grooves and wherein each of the grooves forms a complete ring.

4. The lead supporting device of claim 3, wherein a cross-section of each of the grooves in a lengthwise direction of the guide rod is a rectangular and a cross-section of each of the protrusions in the lengthwise direction of the guide rod is a rectangular.

5. The lead supporting device of claim 1, wherein the gripping rod includes a connecting end where an upper flat portion and a lower flat portion are formed to be parallel to each other and a connecting hole is formed to penetrate the gripping rod from the upper flat portion to the lower flat portion, wherein the first link include an end disposed on the upper flat portion and having a first link hole, the second link include an end disposed under the lower flat portion and having a second link hole, and wherein the first link and the second link are connected to the gripping rod by inserting a connecting shaft through the first link hole, the connecting hole, and the second link hole.

* * * * *